US006393668B1

(12) United States Patent
Olson et al.

(10) Patent No.: US 6,393,668 B1
(45) Date of Patent: May 28, 2002

(54) DECORATIVE PAPER HOLDER

(75) Inventors: Jenna Olson; Christopher Hardy, both of Springfield, IL (US)

(73) Assignee: Design Ideas, Ltd., Springfield, IL (US)

( * ) Notice: Subject to any disclaimer, the term of this patent is extended or adjusted under 35 U.S.C. 154(b) by 0 days.

(21) Appl. No.: 09/439,694

(22) Filed: Nov. 15, 1999

(51) Int. Cl.[7] ..... A44B 21/00; A44B 9/00; G09F 3/16

(52) U.S. Cl. ..... 24/67 R; 24/67.9; 24/531; 24/546

(58) Field of Search ..... 24/67 R, 67.9, 24/67.5, 67.11, 531, 546

(56) References Cited

U.S. PATENT DOCUMENTS

| | | | | | |
|---|---|---|---|---|---|
| D2,572 | S | | 2/1867 | Lawrence | |
| 203,176 | A | | 4/1878 | McKnight | |
| 353,482 | A | | 11/1886 | Cottele | |
| 355,196 | A | | 12/1886 | Morrell | |
| 393,413 | A | | 11/1888 | Young, Jr. | |
| D22,337 | S | | 4/1893 | Adams | |
| 528,062 | A | | 10/1894 | Anderson | |
| D28,791 | S | | 6/1898 | Calrke | |
| D32,650 | S | | 5/1900 | Clark | |
| D33,978 | S | | 1/1901 | Harvey | |
| D44,635 | S | | 9/1913 | Fleischmann | |
| D44,957 | S | | 12/1913 | Grizzard | |
| D47,198 | S | | 4/1915 | Presron | |
| 1,783,840 | A | * | 12/1930 | Goeller | 24/546 |
| D107,648 | S | | 12/1937 | Katz | |
| 2,171,103 | A | | 8/1939 | Silverman | |
| D118,423 | S | | 1/1940 | Aaronson | |
| D123,073 | S | | 10/1940 | Bosworth | |
| 2,262,663 | A | | 11/1941 | Silverman | |
| D133,477 | S | | 8/1942 | Katz | |
| D138,958 | S | | 10/1944 | Katz | |
| D142,485 | S | | 10/1945 | Koven | |
| D142,584 | S | | 10/1945 | Philippe | |
| D145,055 | S | | 6/1946 | Boucher | |
| D146,671 | S | | 4/1947 | Mason et al. | |
| D147,245 | S | | 8/1947 | Katz | |
| 2,426,571 | A | | 8/1947 | Wyanne, Sr. et al. | |
| D147,441 | S | | 9/1947 | Katz | |
| D149,067 | S | | 3/1948 | Katz | |
| D149,069 | S | | 3/1948 | Katz | |
| D149,187 | S | | 4/1948 | Katz | |
| D155,996 | S | | 11/1949 | Gowland | |
| D159,594 | S | | 8/1950 | Boucher | |
| D160,424 | S | | 10/1950 | Philippe | |
| D161,921 | S | | 2/1951 | Green | |
| D163,630 | S | | 6/1951 | Pollock | |
| D173,734 | S | | 12/1954 | Katz | |
| D178,357 | S | | 7/1956 | Galef | |
| D180,180 | S | | 4/1957 | Erenhouse | |
| D185,075 | S | | 5/1959 | Erenhouse | |
| 3,016,224 | A | | 1/1962 | Hall | |
| D199,424 | S | | 10/1964 | Weiss | |
| 3,576,697 | A | | 4/1971 | Lorch | |
| 4,184,233 | A | | 1/1980 | Jacobson | |
| D258,996 | S | | 4/1981 | Costantino | |
| 4,286,358 | A | * | 9/1981 | Levin | 24/67.11 |

(List continued on next page.)

*Primary Examiner*—Victor N. Sakran
(74) *Attorney, Agent, or Firm*—Saidman DesignLaw Group

(57) ABSTRACT

A paper holder which includes a stock clip (e.g., a standard steel paper clip or an alligator clip) and a separate decorative portion which is attached thereto. The decorative portion is preferably made from the same material as the stock clip and is shaped to resemble an insect or bug. Optionally, the paper holder of the present invention may include an adhesive portion which allows the paper holder to be attached to a relatively flat surface. In addition, in an alternate embodiment, the stock clips is an integral part of the decorative portion.

18 Claims, 9 Drawing Sheets

U.S. PATENT DOCUMENTS

| | | | | | |
|---|---|---|---|---|---|
| 4,389,755 | A | * | 6/1983 | Villa-Real | 24/67.9 |
| D290,971 | S | | 7/1987 | Quilty | |
| 4,761,862 | A | * | 8/1988 | Hiromori | 24/67.9 |
| 5,357,653 | A | * | 10/1994 | Van Ardenne | 24/67.9 |
| D385,511 | S | | 10/1997 | Grimes | |
| D399,875 | S | | 10/1998 | Lo | |
| D401,884 | S | | 12/1998 | Gruosi | |
| 5,845,518 | A | | 12/1998 | Webber | |
| D419,602 | S | * | 1/2000 | Mori | D19/91 |
| 6,079,419 | A | * | 6/2000 | Perlsweig | 132/60 |
| 6,149,117 | A | * | 11/2000 | Shao | 24/67 R |

* cited by examiner

DECORATIVE PAPER HOLDER

BACKGROUND OF THE INVENTION

1. Field of the Invention

The present invention relates to a device for clipping or holding paper.

2. Description of Related Art

Devices for clipping and holding paper are of many different shapes and varieties. Perhaps the most common is the standard steel paper clip, countless numbers of which adorn the desks of businesspeople throughout the world.

There have been meager attempts to incorporate decorative elements into such devices. Grizzard, U.S. Pat. No. Des. 44,957, shows a paper clip shaped to resemble a dollar sign. Quilty, U.S. Pat. No. Des. 290,971, shows a paper clip shaped like a musical clef. Lo, U.S. Pat. No. Des. 399, 875, shows a paper clip shaped to resemble a crab.

However, the decorative elements shown in Grizzard, Quilty and Lo are not separable from the paper holding portion, thus limiting the shape, size and complexity of the decorative portion. In addition, the paper clips shown in Grizzard, Quilty and Lo do not incorporate standard clips that are readily available, (hereafter referred to as "stock clips"), which adds to the complexity and expense of products based on these designs.

OBJECTS AND SUMMARY OF THE INVENTION

It is an object of the present invention to provide a paper holder which is aesthetically pleasing.

It is a further object of the present invention to provide a paper holder which is simple and economical to manufacture.

The foregoing and other objects are achieved in accordance with the present invention through the provision of a paper holder having a stock clip (e.g., a standard steel paper clip or an alligator clip) and a separate decorative portion which is attached thereto. The decorative portion is preferably made from the same material as the stock clip and is shaped to resemble an insect or bug. Optionally, the paper holder of the present invention may include an adhesive portion which allows the paper holder to be attached to a relatively flat surface.

BRIEF DESCRIPTION OF THE DRAWINGS

The present invention will be more fully appreciated as the same becomes better understood from the following detailed description of the present invention when viewed in conjunction with the accompanying drawings, in which.

DETAILED DESCRIPTION OF THE PREFERRED EMBODIMENTS

Figure 1:
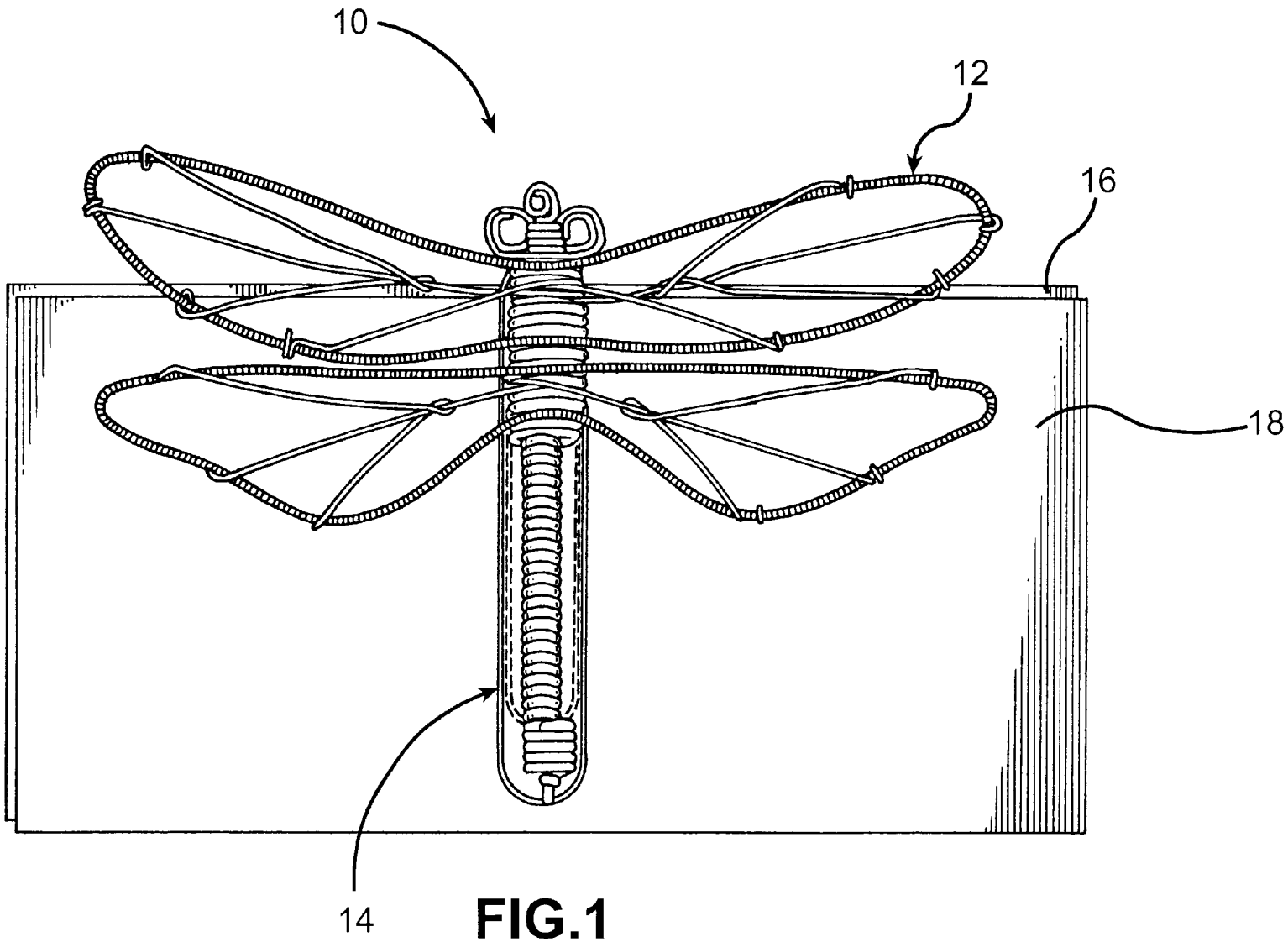
FIG. 1 is a top view of a first embodiment of the paper holder of the present invention, showing the paper holder clipping two sheets of paper.
Figure 2:
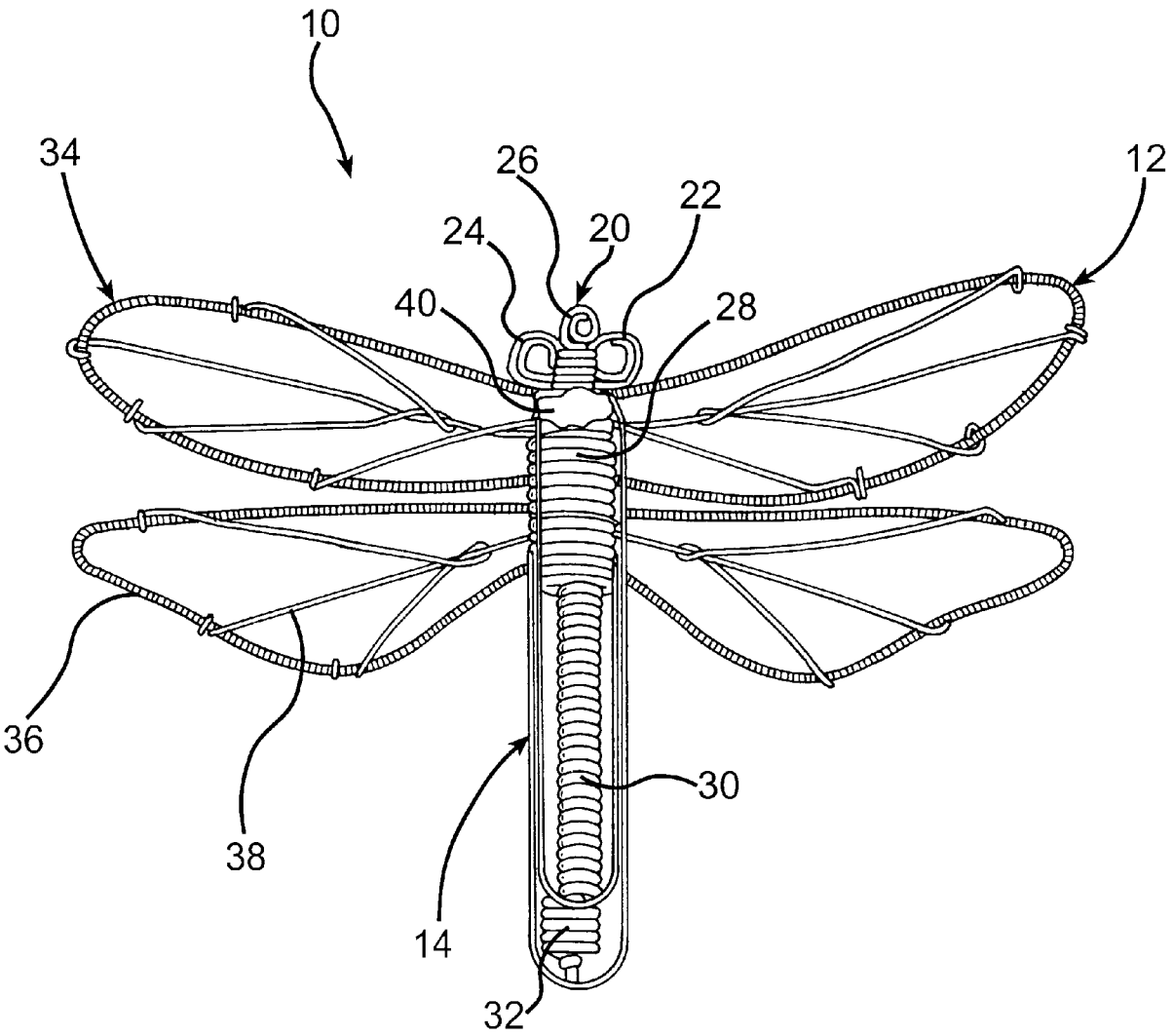
FIG. 2 is a bottom view of the embodiment of FIG. 1.

Referring now to FIGS. 1 & 2, reference numeral 10 generally refers to a paper holder according to a first preferred embodiment of the present invention. Paper holder 10 is preferably made entirely of metal and comprises a decorative portion 12 and a paper holder portion in the form of a paper clip 14.

Paper clip 14 preferably comprises a standard steel paper clip, for reasons of economy of manufacture, and is shown in FIG. 1 holding two pieces of a paper 16 and 18. More specifically, paper clip 14 comprises a single length of wire having opposite end portions bent into a U-shaped configuration to provide two distinct, yet cooperating U-shaped portions, wherein one of the U-shaped portions is longer than the other. Decorative portion 12 is preferably made entirely of steel wire and rods and is shaped to resemble a dragonfly. However, as will become evident herein, decorative portion 12 can be shaped to resemble a wide variety of insects or other small creatures.

Referring now to FIG. 2, decorative portion 12 includes a head 20, a body 28, a tail 30, and wings 34. Head 20 and tail 30 are located at opposite ends of body 28 and wings 34 are attached body 28 near head 20 in a manner to be described in greater detail hereinafter.

Head 20 comprises two eyes 22 and 24, between which are located a mouth 26. Eyes 22 and 24 and mouth 26 are each preferably formed by a piece of medium-gauge wire (similar in thickness to paper clip 14) which has been wound into irregular concentric loops at one end and extends from head 20 to tail 30, forming a core (not shown) of body 28.

Body 28 preferably comprises medium-gauge wire wrapped around the core. Tail 30 also preferably comprises medium-gauge wire wrapped around the core, but is smaller in overall diameter than body 28. Tip 32 is preferably larger in overall diameter than tail 30, but smaller in overall diameter than body 28.

Wings 34 are comprised of an outer portion 36 formed of spiral-wound wire and infrastructure 38 which is formed of light-gauge wire. Wings 34 are preferably secured to body 28 by soldering outer portion 36 to body 28. Infrastructure 38 is preferably looped around outer portion 36 at a plurality of different locations spaced about the periphery of outer portion 36, as shown in FIGS. 1 & 2. Infrastructure 38 also is looped about body 28. Thus, infrastructure 38 provides added structural support for outer portion 36 and assists in securing wings 34 to body 28.

Paper clip 14 is preferably permanently attached to decorative portion 12. In FIG. 2, paper clip 14 is shown as being attached by solder 40. However, any convenient means of affixing paper clip 14 may be used, such an adhesive. Paper clip 14 is also preferably oriented parallel to body 28 and tail 30 so that paper clip 14 appears to be an integral part of body 28.

Figure 3:
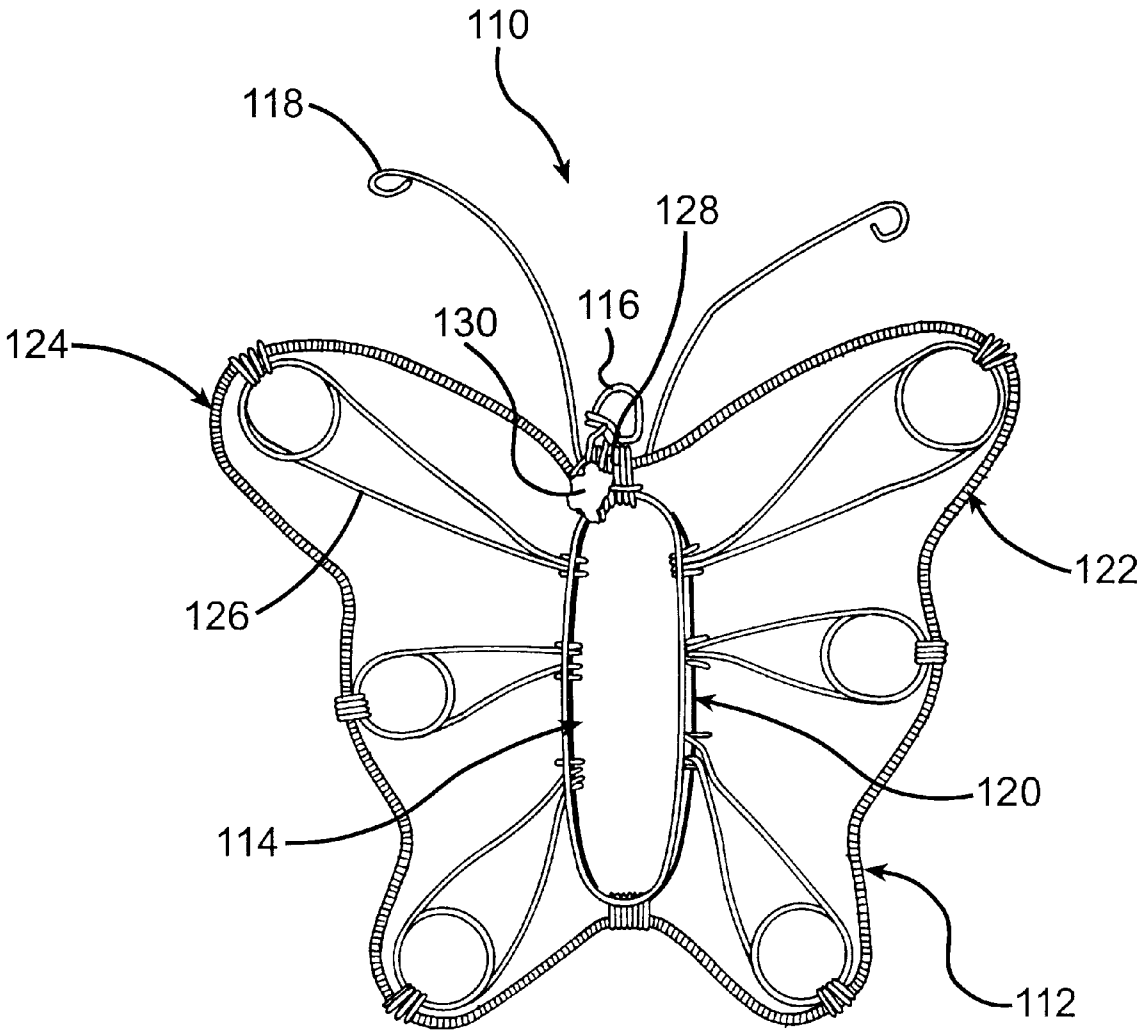
FIG. 3 is a bottom view of a second embodiment of the present invention.

Referring now to FIG. 3, reference numeral 110 generally refers to a second embodiment of a paper holder of the present invention.

As with paper holder 10, paper holder 110 includes a decorative portion 112 and a standard steel paper clip 114. Decorative portion 112 is shaped to resemble a butterfly.

More particularly, decorative portion 112 includes a body 120 that comprises a portion of paper clip 114 which is wrapped in spiral-wound wire. Decorative portion 112 also includes a head 116 and antennae 118 which extend forwardly from a body 120 and are attached to body 120 by a binding 128 that is wrapped around a portion of body 120. Binding 128 may be further secured with solder 130.

Decorative portion 112 further includes wings 122 that extend outwardly to the left and right of body 120. Wings 122 each comprise an outer portion 124 formed of spiral-wound wire and an infrastructure 126 that is looped around outer portion 124 and body 120, thereby providing structural support.

Figure 4:
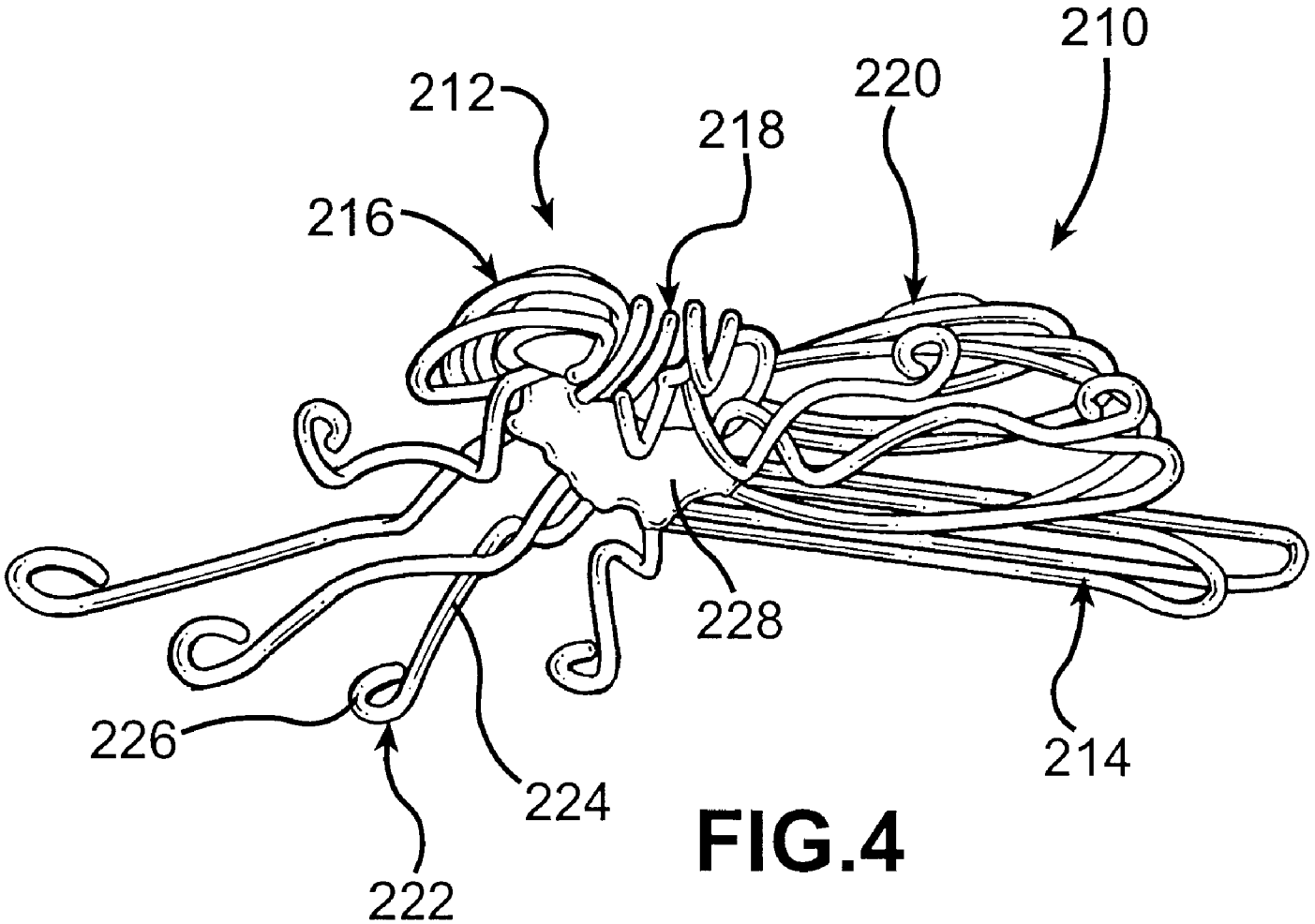
FIG. 4 is a side view of a third embodiment of the present invention.

Referring now to FIG. 4, reference numeral 210 generally refers to yet another embodiment of a paper holder of the present invention.

Paper holder 210 includes a decorative portion 212 and a standard steel paper clip 214. Decorative portion 212 is shaped to resemble a spider.

Decorative portion 212 preferably includes body 218, a head 216, a tail 220 and legs 222. Head 216 and tail 220 are each formed by a concentrically-spiraled piece of wire. Legs 222 each extend downwardly from body 218 forming a gently curved portion 224 and terminating in a looped end portion 226.

Stock paper clip 214 is affixed to the underside of decorative portion 212 with solder 228, and is preferably aligned with head 216, body 218 and tail 220 so that paper clip 214 appears to be an integral part of body 218.

Figure 5:
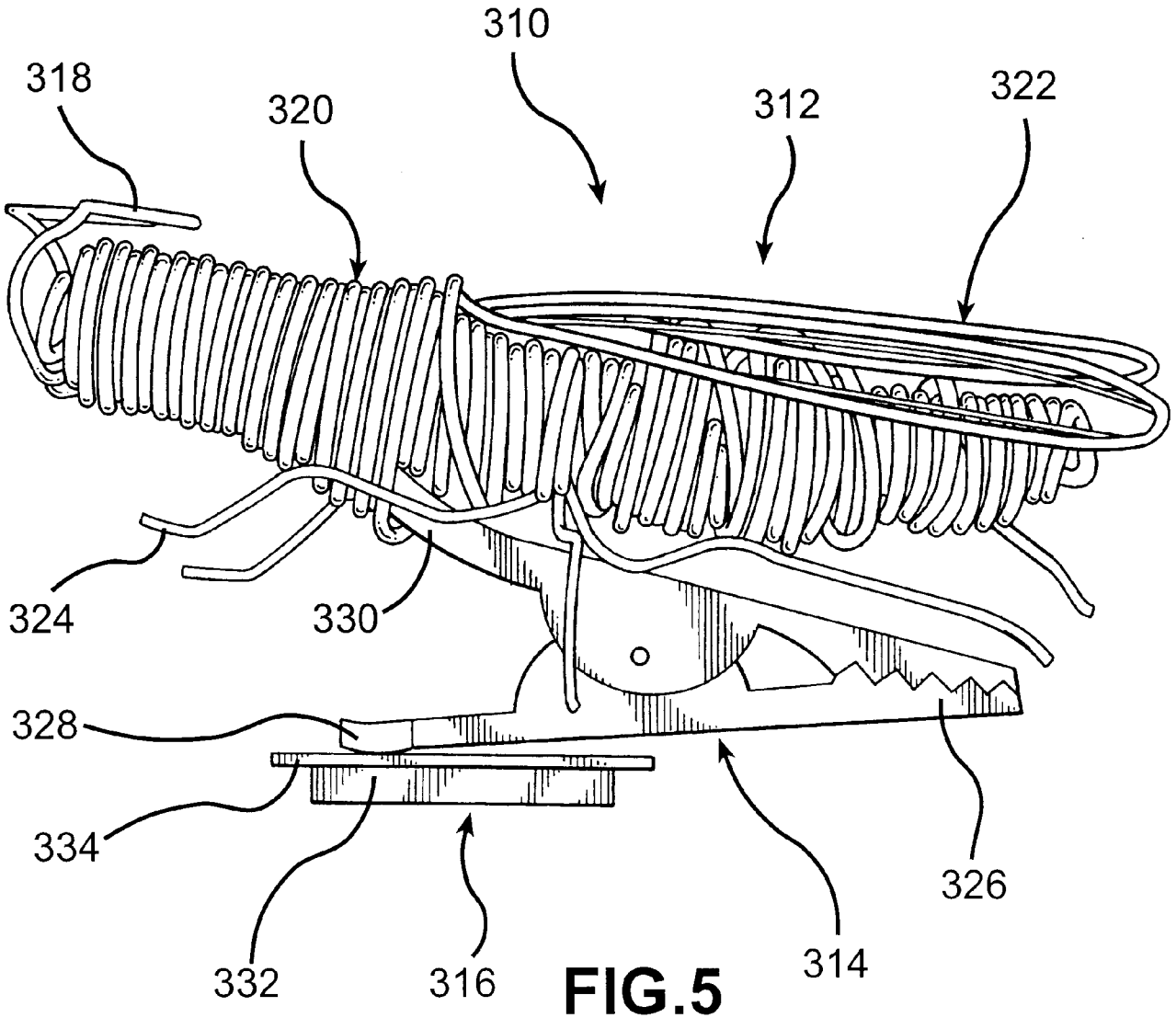
FIG. 5 is a side view of a fourth embodiment of the present invention.
Figure 6:
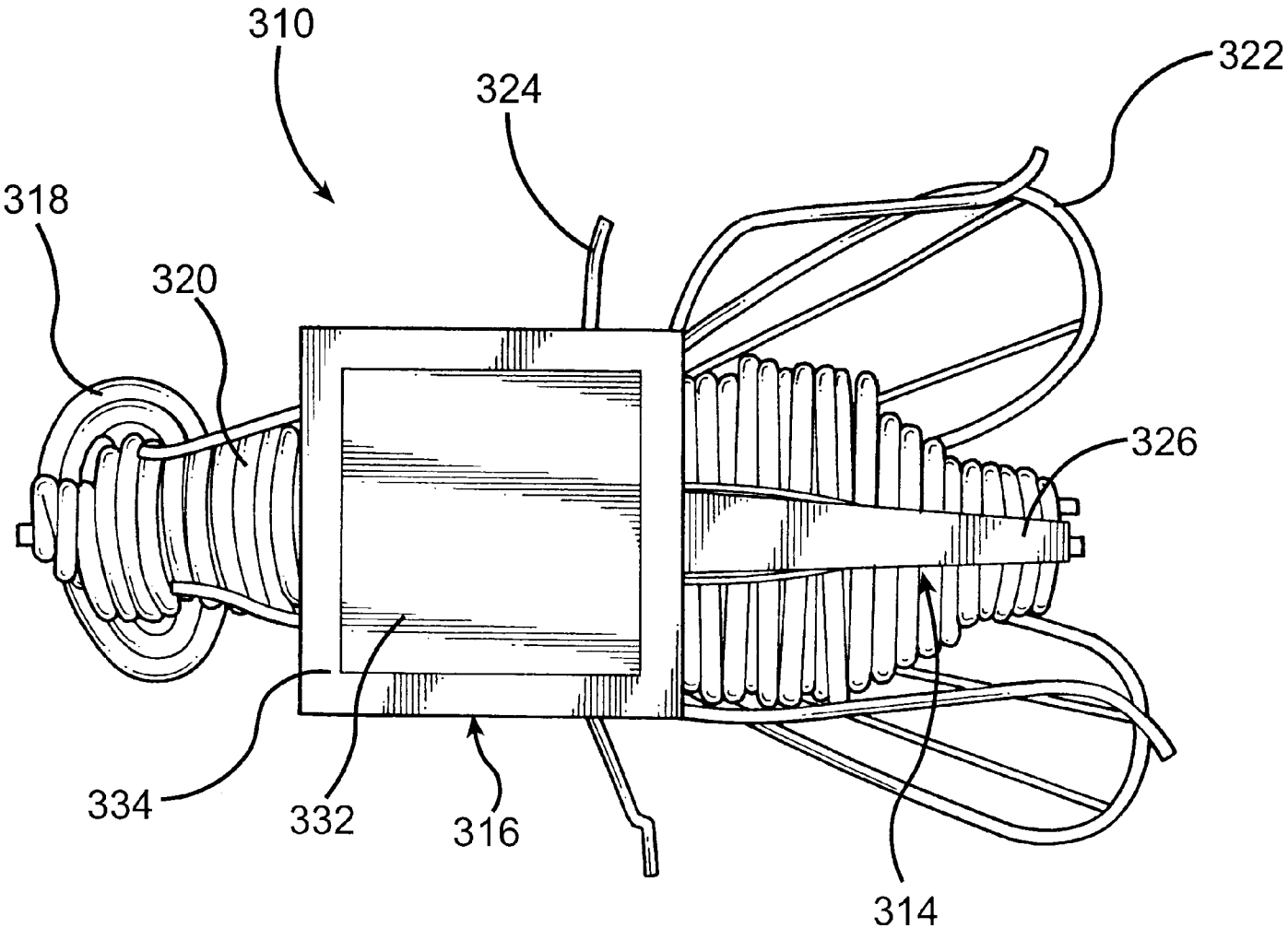
FIG. 6 is a bottom view of the embodiment of FIG. 5.

Referring now to FIGS. 5 and 6, reference numeral 310 generally refers to yet another embodiment of a paper holder of the present invention. Paper holder 310 comprises a decorative portion 312, a standard metal alligator clip 314 and an adhesive portion 316.

Decorative portion 312 is preferably shaped to resemble an insect-like creature, having a head 318, an elongated body 320, wings 322 and legs 324. Head 318 is made of one or more pieces of medium-gauge wire, each of which are wound into irregular loops at one end and extend longitudinally through body 320, forming the core (not shown). Body 320 comprises medium-gauge wire irregularly spiral-wrapped around the core.

Wings 322 are affixed to body 320 and are shown as being elongated and "swept back". However, a wide variety of shapes and orientations are possible for wings 322.

Legs 324 are soldered to body 320 and extend outwardly therefrom. Obviously, legs 324 may be affixed to body 320 by any convenient means, including, for example, weaving legs 324 into the wrapped wire of body 320.

A readily available, stock alligator clip 314 is preferably attached to the underside of body 320 and is longitudinally aligned with body 320. As with paper clip 14 of the embodiment shown in FIG. 1, alligator clip 314 is located and aligned to appear as an integral part of decorative portion 312. Alligator clip 314 comprises a spring-loaded fastening device having jaws 326 with a saw-like edge that resemble those of an alligator, a first handle 328, and a second handle 330. Alligator clip 314 is preferably affixed to body 320 by weaving second handle 330 into the spiral-wrapped wire of body 320.

Adhesive portion 316 preferably includes an adhesive mounting plate 334 and double-sided tape 332. Alternatively, any suitable adhesive could be substituted for double-sided tape 332. Mounting plate 334 is soldered to first handle 328.

As is best shown in FIG. 6, mounting plate 334 is preferably slightly larger in width and length than tape 332, so that tape 332 is not visible when paper holder 310 is affixed to a surface.

Figure 7:
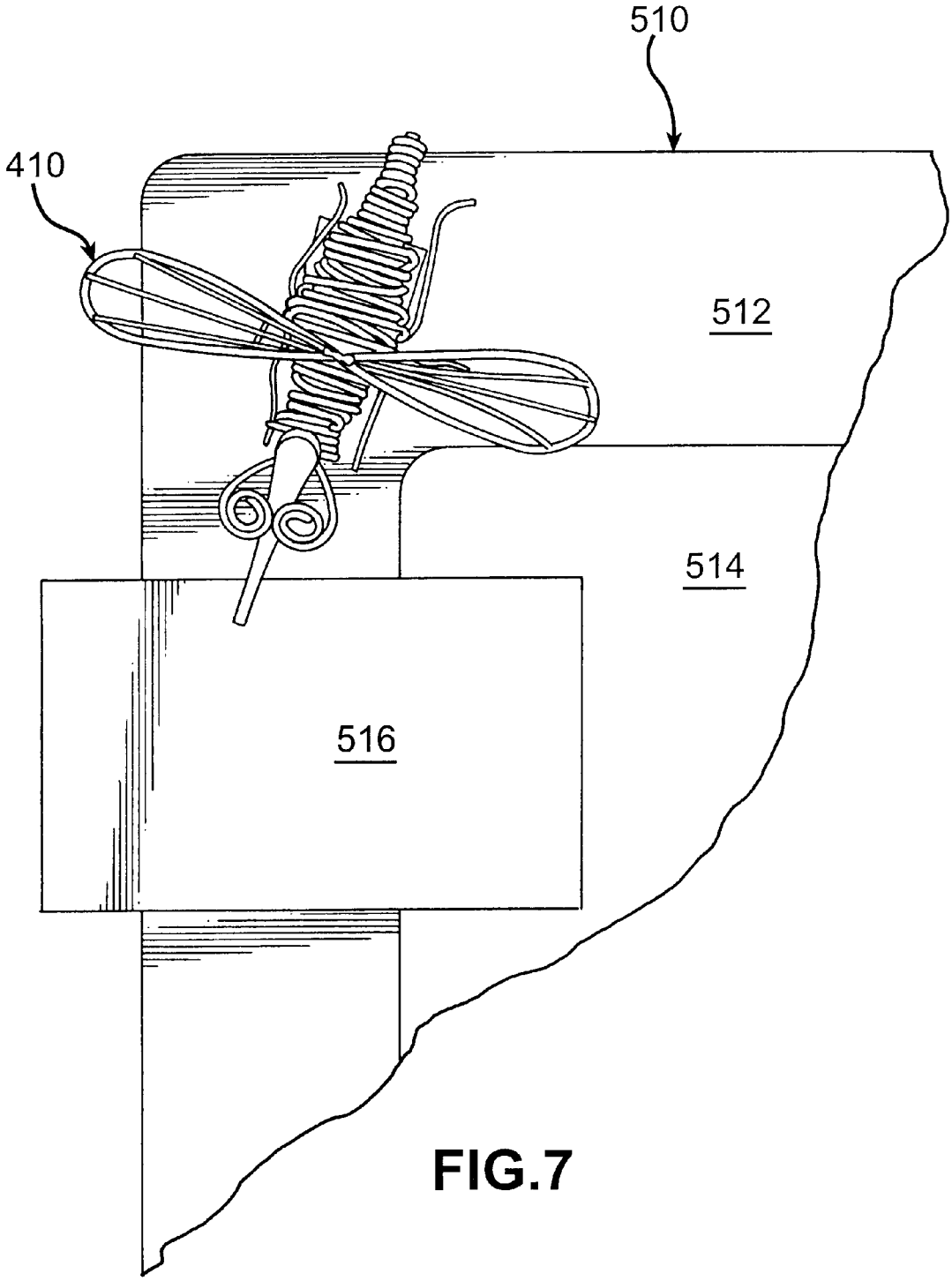
FIG. 7 is a top, partially fragmentary view showing a fifth embodiment of the present invention in use.

FIG. 7 shows yet another embodiment of the paper holder of the present invention, indicated generally by reference numeral 410, in use. Paper holder 410 is affixed to a case 512 for a computer monitor 510 and is holding a note 516.

Figure 8:
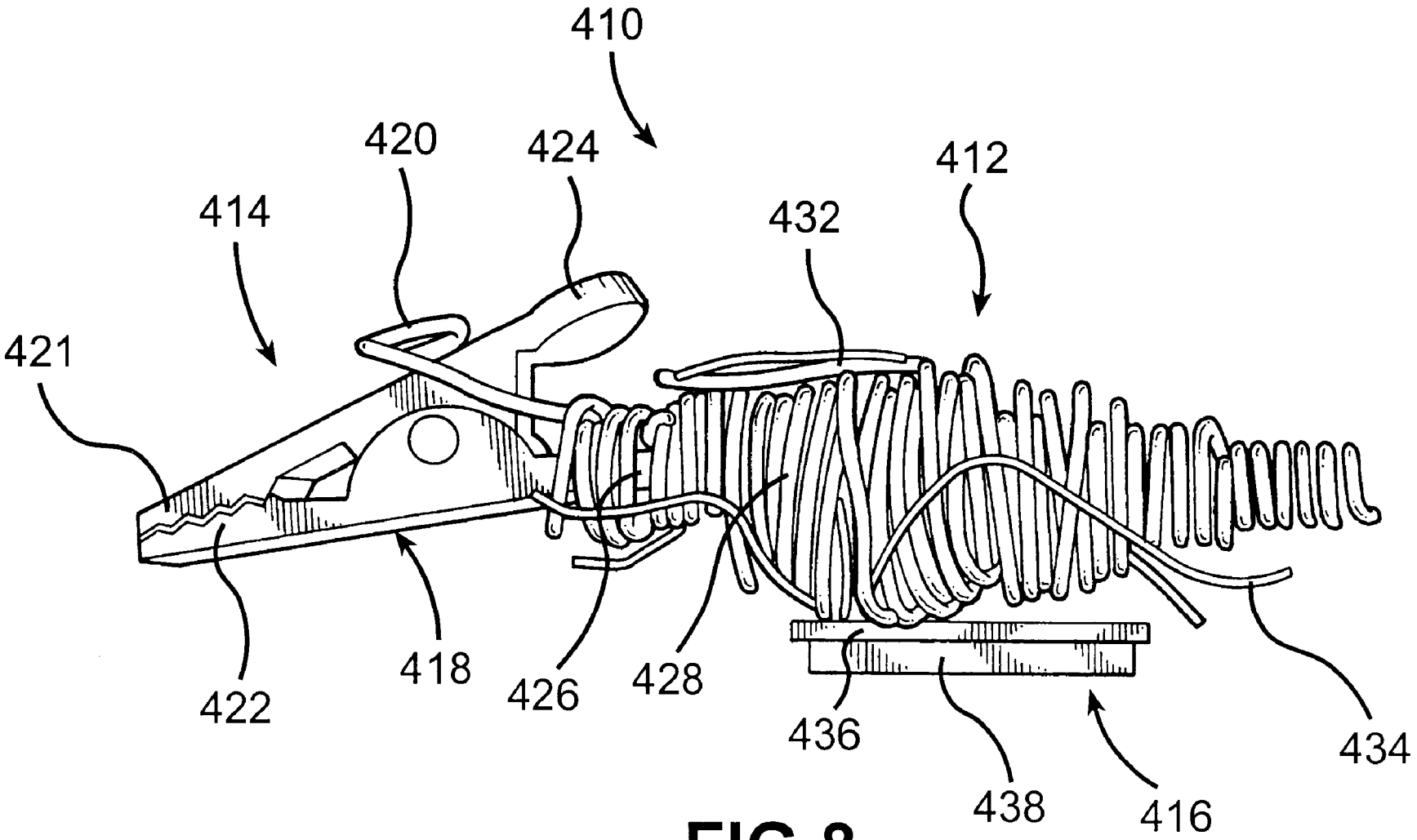
FIG. 8 is a side view of the fifth embodiment.
Figure 9:
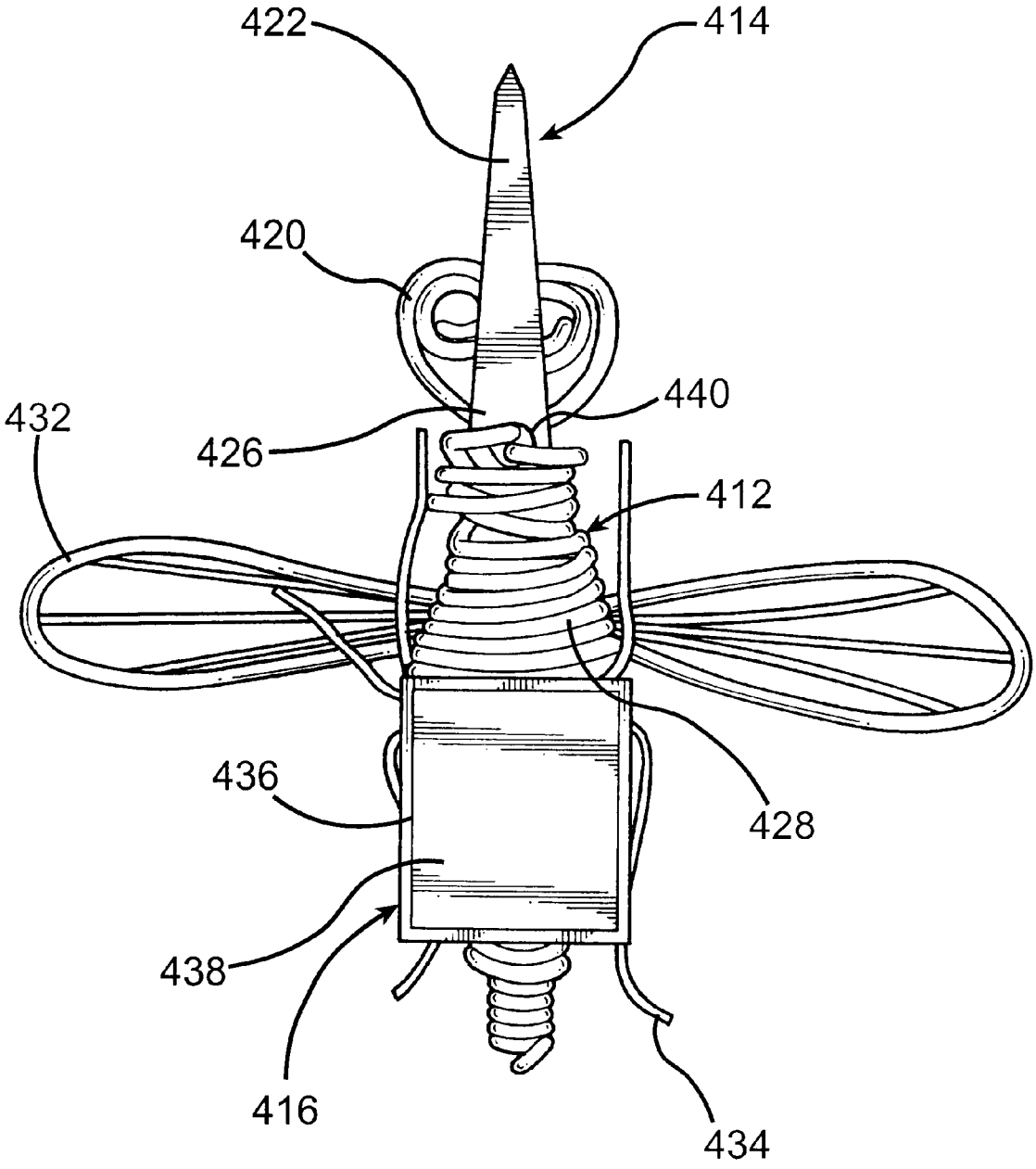
FIG. 9 is a bottom view of the embodiment of FIG. 8.

FIGS. 8 and 9 shows paper holder 410 in more detail. Paper holder 410 is very similar to paper holder 310 (FIGS. 5 & 6) and comprises a decorative portion 412 and an adhesive portion 416 including a mounting plate 436 and double-sided tape 438. Decorative portion 412 is similar to decorative portion 312 (FIGS. 5 & 6) in that it is shaped to resemble an insect-like creature and includes an elongated body 428, wings 432 and legs 434.

However, unlike paper holder 310, alligator clip 414 of paper holder 410 forms a head 418 of the insect, and the jaws 422 of alligator clip 414 form a mouth 421. Alligator clip 414 includes a first handle 424, and a second handle 426. Second handle 426 is enveloped by spiral-wrapped wire which forms body 428. As is best seen in FIG. 9, second handle 426 preferable includes an aperture 440. Aperture 440 further secures second handle 426 to body 428. Two pieces of wire from body 428 pass through aperture 440, extend upwardly to either side of alligator clip 414, and are curved into concentric loops which form eyes 420.

Those skilled in the art will appreciate that the conception, upon which this disclosure is based, may readily be utilized as a basis for the designing of other products for carrying out the several purposes of the present invention. It is important, therefore, that the claims be regarded as including such equivalent constructions insofar as they do not depart from the spirit and scope of the present invention as defined in the appended claims.

Further, the purpose of the foregoing Abstract is to enable the U.S. Patent and Trademark Office, and the public generally, and designers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

It can be seen from the above that an invention has been disclosed which fulfills all the objects of the invention. It is to be understood, however, that the disclosure is by way of illustration only and that the scope of the invention is to be limited solely by the following claims:

We claim as our invention:

1. A paper holder, comprising:

a decorative portion shaped to resemble a small creature; and a paper clip affixed to said decorative portion;

wherein said paper clip and said decorative portion are both made of steel wire and are securely fastened together;

wherein said paper clip comprises a single length of wire having opposite end portions bent into a U-shaped configuration to provide two distinct, cooperating U-shaped gripping portions, one of said two U-shaped gripping portions being longer than the other of said two U-shaped gripping portions.

2. The paper holder of claim 1, wherein said small creature comprises an insect.

3. The paper holder of claim 2, wherein said insect comprises a dragonfly.

4. The paper holder of claim 2, wherein said insect comprises a spider.

5. The paper holder of claim 2, wherein said insect comprises a butterfly.

6. The paper holder of claim 5, wherein said butterfly comprises a head, a body and a plurality of wings.

7. The paper holder of claim 6, wherein said body comprises a portion of said paper clip.

8. The paper holder of claim 1, wherein said small creature comprises a bug that includes a head, a body, a tail, and a plurality of wings.

9. The paper holder of claim 8, wherein each of said plurality of wings comprise a web and an outer portion formed of spiral-wound wire.

10. A paper holder, comprising:

a decorative portion shaped to resemble a small creature; and an alligator clip affixed to said decorative portion;

wherein said alligator clip is made of steel and said decorative portion is made of steel wire, said alligator clip and said decorative portion being securely fastened together;

wherein said alligator clip comprises a spring-loaded fastening device having a first handle, a second handle, and jaws with a saw-like edge that resemble those of an alligator.

11. The paper holder of claim 10, wherein said small creature comprises an insect.

12. The paper holder of claim 11, wherein said insect includes a body formed of spiral-wound wire, a head and a mouth.

13. The paper holder of claim 12, wherein said alligator clip forms said head and said mouth.

14. The paper holder of claim 12, wherein said second handle is affixed to said body.

15. The paper holder of claim 12, wherein said first handle is not affixed to said decorative portion.

16. The paper holder of claim 10, further comprising an adhesive portion for affixing said paper holder to a surface.

17. The paper holder of claim 16, wherein said adhesive portion comprises double-sided tape and a mounting plate.

18. The paper holder of claim 16, wherein said adhesive portion comprises a hook and loop fastener.

* * * * *